US006413349B1

(12) United States Patent
Cannata

(10) Patent No.: US 6,413,349 B1
(45) Date of Patent: Jul. 2, 2002

(54) METHOD OF MANUFACTURING FURNITURE STRUCTURES USING LAMINATED SHEET MATERIALS

(76) Inventor: Philip C. Cannata, 319 A Rear, Boston, MA (US) 02210

( * ) Notice: Subject to any disclaimer, the term of this patent is extended or adjusted under 35 U.S.C. 154(b) by 0 days.

(21) Appl. No.: 09/560,391

(22) Filed: Apr. 28, 2000

Related U.S. Application Data

(63) Continuation-in-part of application No. 08/924,446, filed on Aug. 26, 1997, now abandoned.

(51) Int. Cl.[7] ..... A47C 7/00; B32B 31/00

(52) U.S. Cl. ..... 156/264; 156/252; 156/257; 156/258; 156/263; 156/268; 108/57.18; 108/57.19; 108/158.11; 108/158.12; 297/440.13; 297/440.14; 297/451.8

(58) Field of Search ..... 156/63, 91, 252, 156/257, 258, 263, 264, 268, 280, 293; 297/440.13, 440.14, 451.8, DIG. 1; 108/158.11, 158.12, 158.13, 57.18, 57.19

(56) References Cited

U.S. PATENT DOCUMENTS

| | | | | |
|---|---|---|---|---|
| 2,707,514 | A | | 5/1955 | Smith |
| 2,887,832 | A | | 3/1959 | Reavis |
| 2,904,105 | A | | 9/1959 | Holden |
| 2,940,513 | A | | 6/1960 | Holden |
| 2,955,647 | A | | 10/1960 | Smith |
| 3,121,588 | A | | 2/1964 | Beckman |
| 3,331,634 | A | | 7/1967 | Harrison |
| 3,695,703 | A | | 10/1972 | Notko |
| 4,067,615 | A | | 1/1978 | Gehry |
| 4,186,965 | A | | 2/1980 | Yarbrough |
| 4,340,251 | A | | 7/1982 | Geoffrey-Dechaume |
| 4,712,837 | A | | 12/1987 | Swilley |
| 4,875,737 | A | | 10/1989 | Cardenas |
| 4,881,779 | A | | 11/1989 | Bubien |
| 4,934,756 | A | | 6/1990 | Webb et al. |
| 5,263,766 | A | | 11/1993 | McCoullough |
| 5,275,467 | A | | 1/1994 | Kawecki |
| 5,382,081 | A | | 1/1995 | Henry |
| 5,382,214 | A | | 1/1995 | Mano |
| 5,445,435 | A | | 8/1995 | Sheckles |
| 5,516,384 | A | | 5/1996 | Mossbeck |
| D375,006 | S | | 10/1996 | Hakansson |
| 5,584,951 | A | * | 12/1996 | MacFarland ..... 156/258 |

OTHER PUBLICATIONS

Gehry Shelve, Met Home, U.S., Sep. 10, 1994, Attached, p. 59.

* cited by examiner

*Primary Examiner*—Jeff H. Aftergut
(74) *Attorney, Agent, or Firm*—Lambert & Associates; Gary E. Lambert; Edward Timmer

(57) ABSTRACT

A method of manufacturing furniture or sculpture by cutting plies from a sheet material, laminating the plies into a beam element, and removing excess portions of the plies. Bars of similar diameters and lengths are cut. The beam elements are interconnected with other beam elements. The bars are inserted into some of the slots, grooves, cut-outs and tabulated apertures in beam elements. By orienting some of the beam elements or some of the bars to be in collinear alignment to a load acting upon the furniture, and by orienting some of the beam elements such that some of the individual plies are disposed with an edge facing forward, a structural object can be created.

17 Claims, 7 Drawing Sheets

METHOD OF MANUFACTURING FURNITURE STRUCTURES USING LAMINATED SHEET MATERIALS

CROSS REFERENCE TO RELATED APPLICATIONS

This application is a continuation-in-part of U.S. application Ser. No. 08/924,446, filed Aug. 26, 1997, now abandoned.

BACKGROUND OF THE INVENTION

This invention relates to a method of manufacturing structural bodies. More particularly, it relates to a method of manufacturing load-bearing objects, including furniture with lightweight sheet materials such as corrugated cardboard and bars made of bamboo, wood, plastic, or other materials.

The use of corrugated laminates in the development of both furniture and load bearing articles has existed for some time. The advantages to using such materials are that they are relatively inexpensive and extremely lightweight. Of course the disadvantages are obvious as well in that the material can only be used in certain environments. The material is not suitable for outdoor furniture. Through the years, a variety of techniques have been utilized to construct load bearing articles of furniture from corrugated cardboard as well as other similar lightweight materials. Most of the prior art of which Applicant is aware provide for the use of structural elements which are die cut from larger sheets of these materials. These structural elements are combined in some manner to create the whole structure.

The prior art to which Applicant refers is suitable for the mass production of the furniture as well as the storage, shipment, and ultimate sale of the furniture in a knocked-down or non-constructed embodiment. Such furniture is intended to be assembled or otherwise built by a purchaser who having little skill and a minimum of tools can successfully build the furniture by following assembly instructions. Specific references of which Applicant is aware which utilize this technology are:

| | |
|---|---|
| Smith | U.S. Pat. No. : 2,806,514 |
| Holden | U.S. Pat. No. : 2,904,105 |
| Holden | U.S. Pat. No. : 2,940,513 |
| Smith | U.S. Pat. No. : 2,955,647 |
| Harrison | U.S. Pat. No. : 3,331,634 |
| Notko | U.S. Pat. No. : 3,695,703 |
| Geoffrey-Dechaume | U.S. Pat. No. : 4,340,251 |
| Cardenas | U.S. Pat. No. : 4,875,737 |
| Bubien | U.S. Pat. No. : 4,881,779 |
| Webb et al. | U.S. Pat. No. : 4,934,756 |
| McCullough | U.S. Pat. No. : 5,263,766 |

All of the articles described by this prior art include blanks which must be folded to form various panels and support structures which are interlinked by means of slots.

Folding of corrugated materials, however, increase the likelihood that the material may rupture or suffer from some other distorting force at that point. Furthermore, all of this prior art has some provision to cover the interlocking elements with panels of folded, tabbed, and slotted blanks, and/or some form of upholstery, in an attempt to make the article more conventional, and thus more aesthetically pleasing. The required folds further limit the covering sheets to a thickness of of only one such corrugated sheet, because multiple sheets, though stronger, would have an even greater propensity to rupture or distort along the fold. A single sheet of corrugated material placed perpendicular to and overlapping a plurality of interspaced, perpendicularly interlocking sheets of like material arranged into an egg crate divider type assembly is subject to failure over the interstices of the interlocking sheets. This would of course negate the original intent of creating an aesthetically pleasing flat surface.

Another invention which utilizes lightweight corrugated materials is Gehry U.S. Pat. No. 4,067,615. Gehry describes an article different from those described above in that Gehry provides a plurality of elements which are cut into certain desired patterns and shapes, and laminated into a continuous structure. Gehry prefers to laminate each sheet perpendicular to the next sheet with respect to the corrugated portion or flutes within each sheet, though he claims this is not necessary. Regardless of the manner in which the Gehry structure is created, the external appearance of the structure is of a continuous laminate extending over the entire structure.

The applicant provides in the present invention an improvement to the prior art using a method of manufacturing load-bearing objects, including furniture with lightweight sheet materials such as corrugated cardboard in combination with bars made of bamboo, wood, plastic or other lightweight materials which do not succumb to the limitations of the interlinked and folded materials such as corrugated cardboard. The applicant incorporates bars of lightweight material into the design of the present invention to add structural strength to the objects and also to improve the aesthetics of the manufactured objects.

SUMMARY OF THE INVENTION

The present invention is directed to a method of constructing furniture and to items of furniture constructed by this method incorporating lightweight sheet materials and bars of lightweight material. An article of furniture built by such a method would comprise a plurality of laminated components including beam elements and connector elements along with bars of other lightweight materials. Each beam element and connector element being a portion of sheet material cut out of a greater sheet of such material and laminated into a beam element or a connector element. A plurality of such beam elements, connector elements and bars are connected together to form the article of furniture. The laminated beam elements and connector elements can be constructed to be load-bearing. The lengths and diameters of the bars can be selected to be load-bearing. The present invention method of manufacturing furniture and other structures by combining a plurality of the beam elements, connector elements and bars in an unlimited number of configurations provides durable furniture which is not only functional structurally but aesthetically appealing in appearance. This method is also readily adapted to use in the creation of sculpture, other works of art, and other items which do not require the structural integrity of furniture but would benefit from the aesthetic appearance of this method of constructing objects.

In some embodiments of the furniture manufactured using the method of the present invention, the sheet material from which the beam elements are constructed comprise laminated cardboard, each of the beams of the corrugated laminates are slotted, grooved or notched, and are interlocked in such a way so as to expose the outer edges of the corrugated laminates forming a skeletal structure. The planes formed by the outer edges of the corrugated laminates run perpendicular to the direction of the load, or in the case of a non-load bearing structure, the planes formed by the outer edges of the corrugated laminates run perpendicular to the direction of view, and are used to define the outer edges of the structure.

Therefore it is a primary object of the present invention to provide a method of manufacturing lightweight, sturdy and durable furniture from sheet materials by laminating a number of such materials together to form structurally sound beam elements which are then utilized in combination with bars of other lightweight materials to construct the article of furniture.

Some embodiments of the furniture and other objects manufactured using the method of the present invention include lightweight bars of materials such as bamboo, wood, plastic among others. Bars of various diameters and lengths, depending on the particular embodiment are incorporated into the designs for structural support as well as aesthetics. In some embodiments, a plurality of bars are inserted through tabulated apertures appropriately sized, depending on the diameter of the bar, to frictionally secure the bar to the beam element at the desired location of the bar relative to the beam. In other embodiments, the bars can be inserted through larger cut-outs in a portion of the beams providing no support to the structure.

The lightweight bars can be joined together in various configurations using either fiber cords to lash two or more bars together or by inserting to or more bars into cut-outs or slots in laminated connector elements. The laminated connector elements can be manufactured using the materials and methods utilized to construct the beam elements. The connector elements can be designed to be load bearing or non-load bearing depending on the design of the furniture or structure.

Another object of the present invention is to provide an aesthetically pleasing article of furniture by utilizing the property of corrugated cardboard aesthetically while more importantly utilizing this same property to provide the necessary structural integrity to support the load the furniture is intended to bear. In some embodiments the lightweight bars are incorporated into the designs of the furniture and other objects in such a way to support the load the particular object is designed to carry with the bars rather than the beam elements.

Yet another object of the present invention is to provide a method of manufacturing furniture by utilizing a skeletal framework of beam elements along with the lightweight bars which can by themselves comprise the finished article of furniture or could alternatively be upholstered.

Still another object of the present invention is to provide an additional use for oftentimes waste sheet materials such as corrugated cardboard, wood and plastic laminates, and other sheet materials which can be cut, notched and fastened to form useful articles of furniture which at the end of their lifetimes can be returned to the recyclable waste stream to be utilized for other purposes.

Another object of the present invention is to provide furniture such as a table, a magazine rack, or room divider among others which are lightweight, sturdy, and rigid made of a plurality of laminated beams and a plurality of lightweight bars. Each beam comprises a plurality of otherwise non rigid corrugated cardboard elements, wherein the lamination of a plurality of such elements provides the rigidity to the beam and the combination of the beams and bars provides the rigidity to the furniture without sacrificing the lightweight characteristics.

Another object of the present invention is to provide furniture and other objects made of a plurality of laminated beams of corrugated cardboard elements and a plurality of lightweight bars wherein the elements of the objects are treated with moisture repellant, sealer, polyurethane or other preservative to provide greater durability and longevity to the products.

Another object of the present invention is to provide furniture and other objects made of a plurality of laminated beams of corrugated cardboard elements and a plurality of lightweight bars wherein the skeletal framework of the beams and bars combine to provide an aesthetically pleasing appearance while providing the necessary structure to allow the furniture to function.

BRIEF DESCRIPTION OF THE DRAWINGS

The invention is pointed out with particularity in the appended claims. The above and other advantages of the invention may be better understood by referring to the following detailed description in conjunction with the drawings in which:

The novel features considered characteristic of the invention are set forth in the appended claims. The invention itself, however, both as to its construction and its method of operation, together with additional objects, features and advantages thereof, will best be understood from the following description of the specific embodiments when read and understood in connection with the accompanying drawings.

DETAILED DESCRIPTION OF THE PREFERRED EMBODIMENTS

Figure 1:
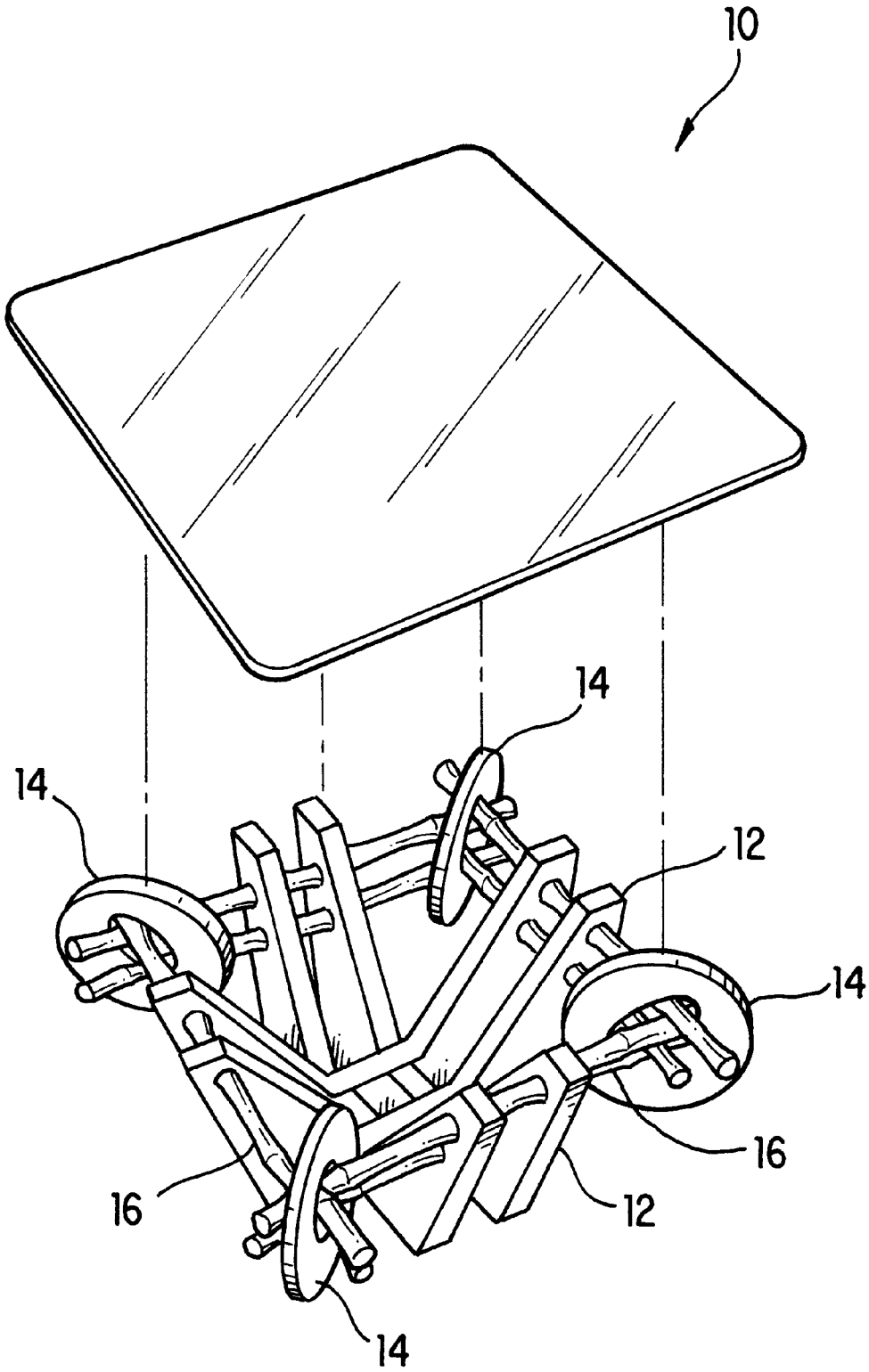
FIG. 1 is a perspective view of a table with a glass top manufactured by the method of constructing furniture in accordance with the present invention.
Figure 2:
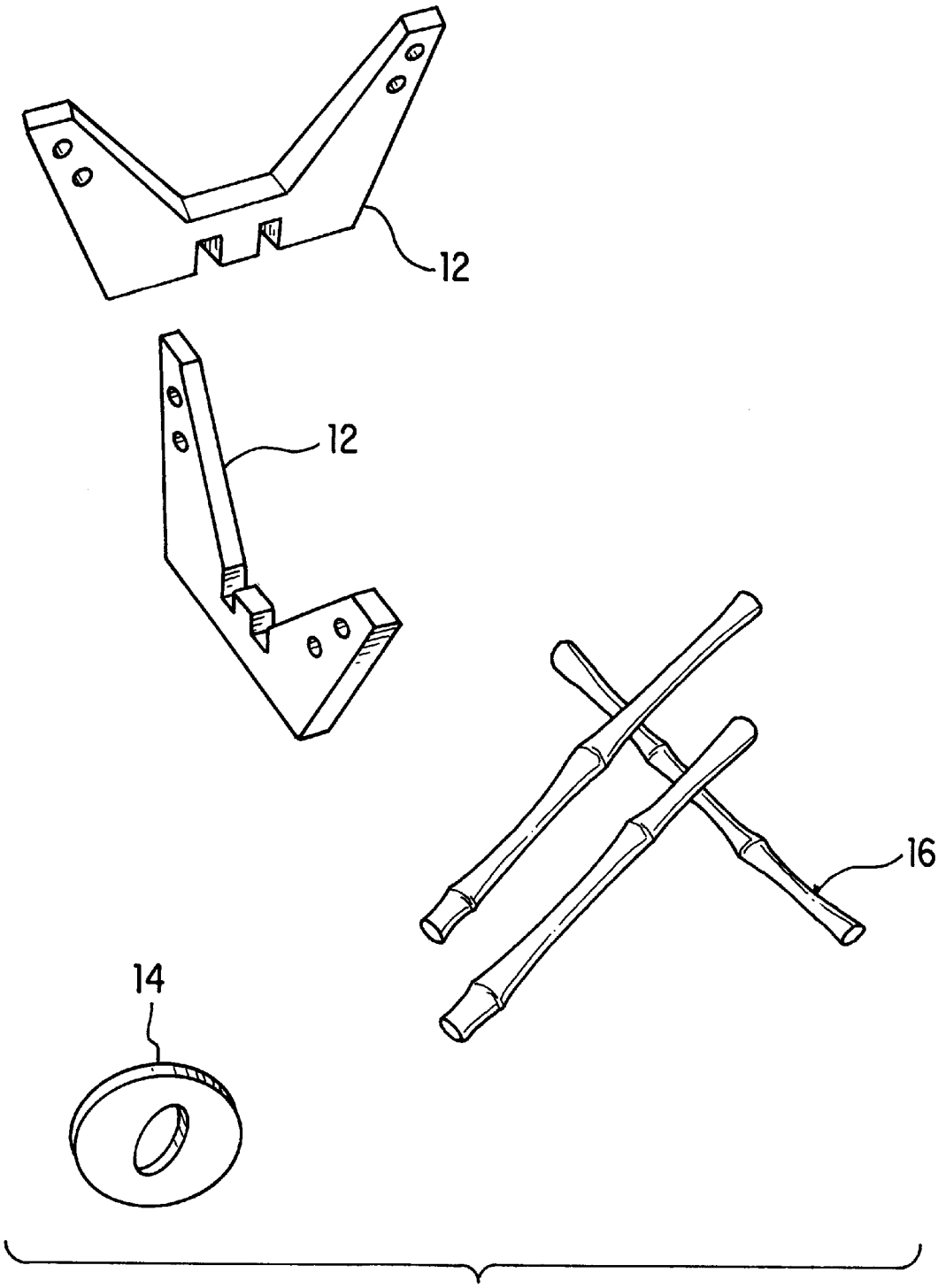
FIG. 2 is a component view of the table of FIG. 1.

Although the particular article of furniture depicted in FIG. 1 is table 10 constructed of a plurality of laminated beam elements 12, laminated connector elements 14 and lightweight bars 16, it is important that it be understood that the particular method of construction can be utilized on any other article of furniture, sculpture, or object of art, and is applicable to beam elements utilizing corrugated cardboard or other solid or corrugated, rigid or non-rigid sheet materials. As such, FIG. 1 depicts an article of furniture constructed with a plurality of corrugated laminate beam elements, connector elements and lightweight bars. The method of assembling such beam elements and other elements of the present invention as shown in FIGS. 2–5 can be used to create load bearing structures such as furniture including but not limited to chairs, shelves, room dividers, sectional seating, footrests, stools, benches, magazine racks and other furniture typically subjected to loads. In other embodiments such as the table in FIG. 6, the load can be supported by the lightweight bars. The present method can also be used for constructing non-load bearing structures such as lamps, sculptures, and works of art.

The method of constructing articles with a skeletal framework of beam elements first comprises assembling a plurality of laminated beam elements and connector elements which can be made from materials including but not limited to cardboard, paper, wood, plastic or foam. Furthermore, the laminated element can readily be made of recyclable material. The materials can be corrugated or non-corrugated, however the use of corrugated material such as corrugated cardboard provides an additional advantage in that greater structural strength per unit of cardboard is gained by the corrugated layer without the additional weight associated with an equally strong non-corrugated unit of layered cardboard. Additionally, corrugated materials provide an aesthetic feature to the article. This aesthetic feature can be further enhanced by incorporating different colored individual plies into the laminated beam elements and connector elements.

The laminated beam elements 12 and connector elements 14 comprise individual plies of cut sheet material glued or otherwise laminated into a beam element. It is preferred that each of the individual plies be laid in successive perpendicular layers like common plywood. Though the number of individual plies comprising a laminated element can vary, the number of individual plies must at least be sufficient to support that portion of load to which the beam element 12 or connector element 14 is subjected. It is well known and understood in the art how to calculate beam sizes based upon materials used in the beam in conjunction with the loads to which any beam is subjected. Of course, increasing the total number of beams to support a load decreases the actual size of each individual beam needed. Additionally, within the skeletal structure of the article itself, there may be some areas which necessarily support a greater amount of load and therefore they should be dimensionally bigger. Applicant contends that no undue experimentation need occur to properly size each beam element, since each element can be easily oversized without adding significant weight to the structure to accommodate any loads expected.

That being said, Applicant has found that beams of sufficient rigidity and strength for use in a chair intended to support the weight of a typical person can be created by the use of approximately three to five single plies of laminated corrugated cardboard. Applicant further contends that a suitable number of plies correlate to beams of approximately one inch in cross-section for vertical elements and approximately one-half inch in cross section for horizontal elements. However, as stated in the above paragraph, formulas as well as suitable tables abound which enable a manufacturer to adequately size any beams based upon material strength, beam size, and load.

Figure 3:
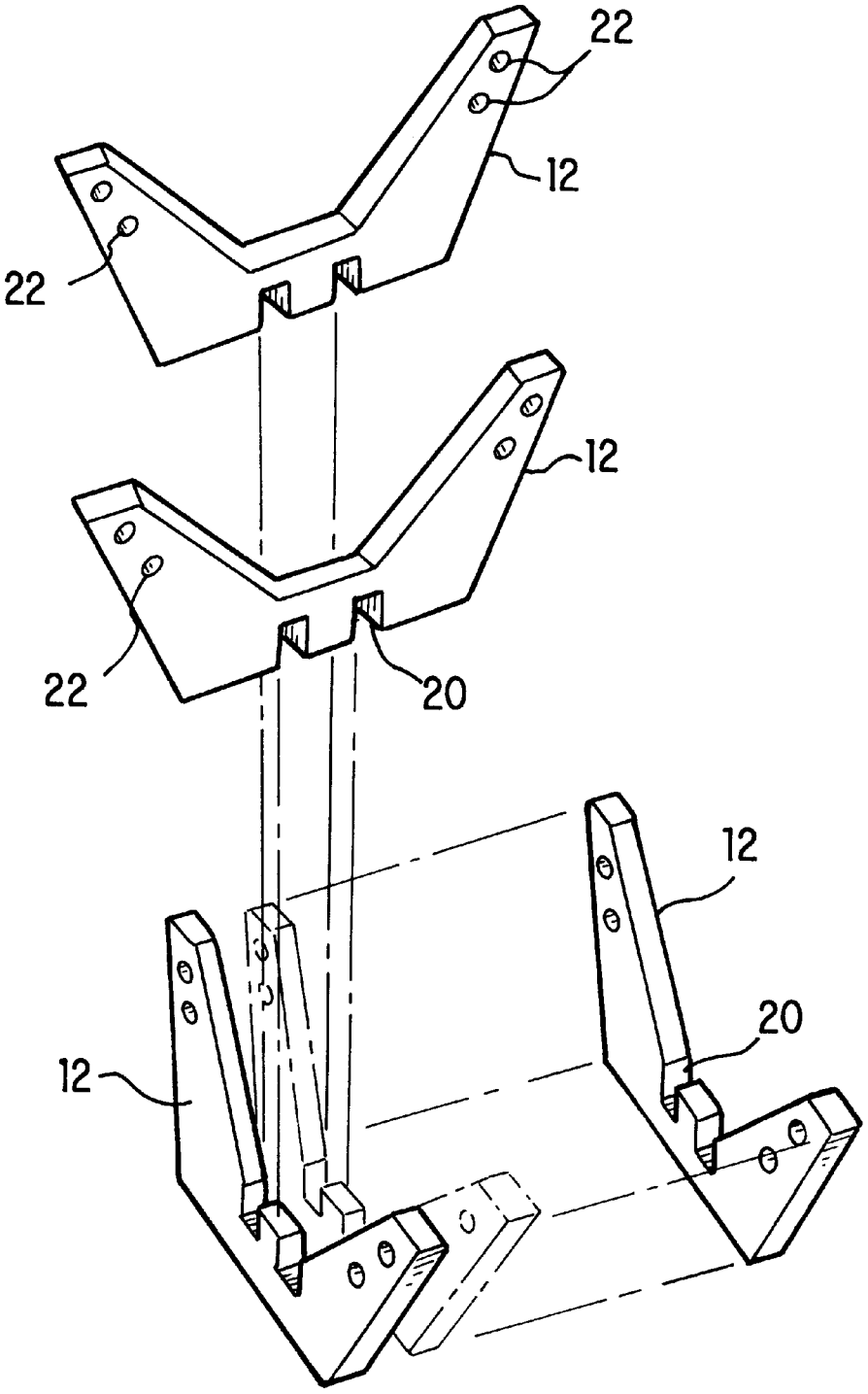
FIGS. 3–5 are perspective views of the base of the table of FIG. 1 showing the assembly thereof.
Figure 4:
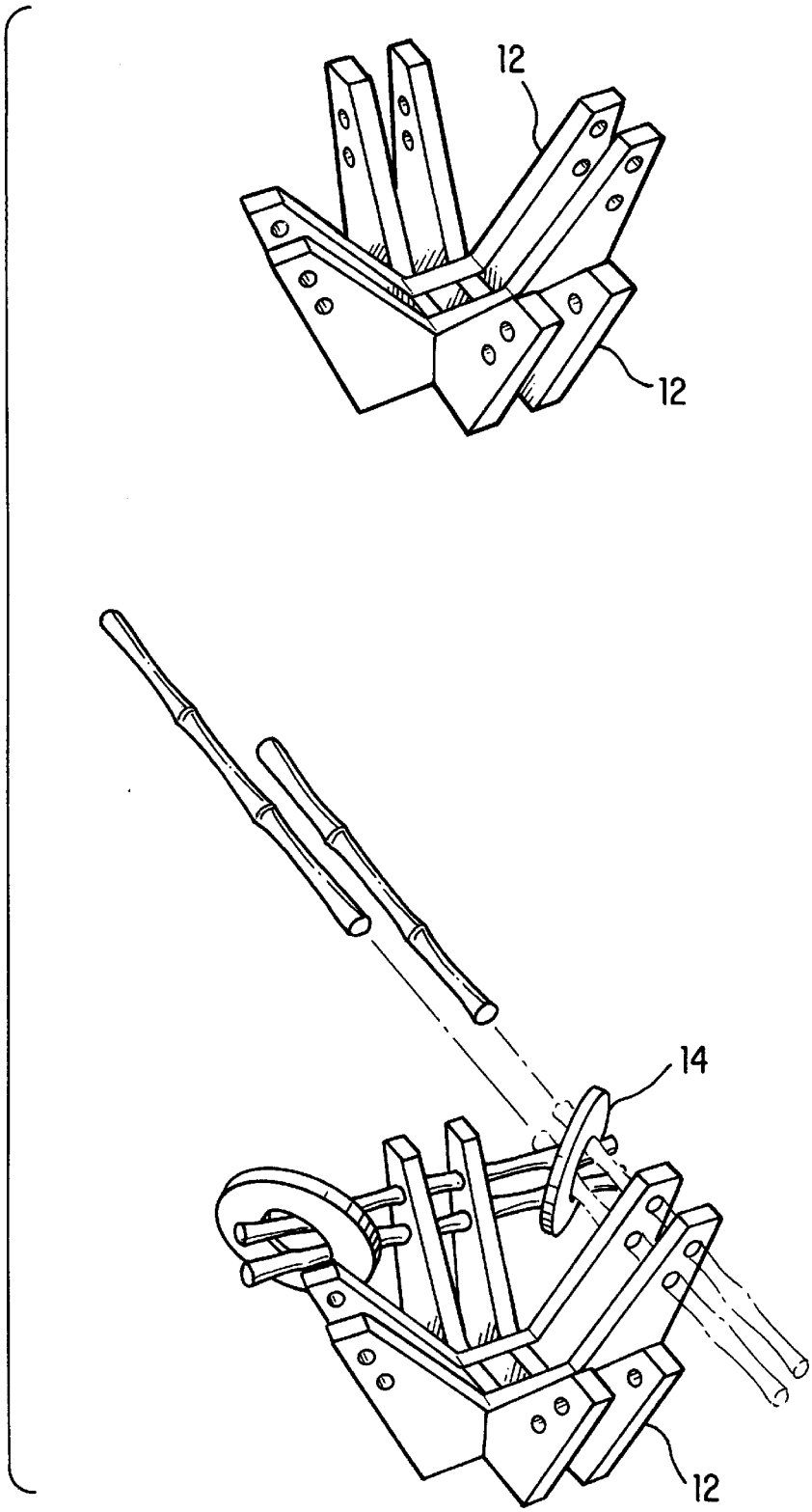
Figure 5:
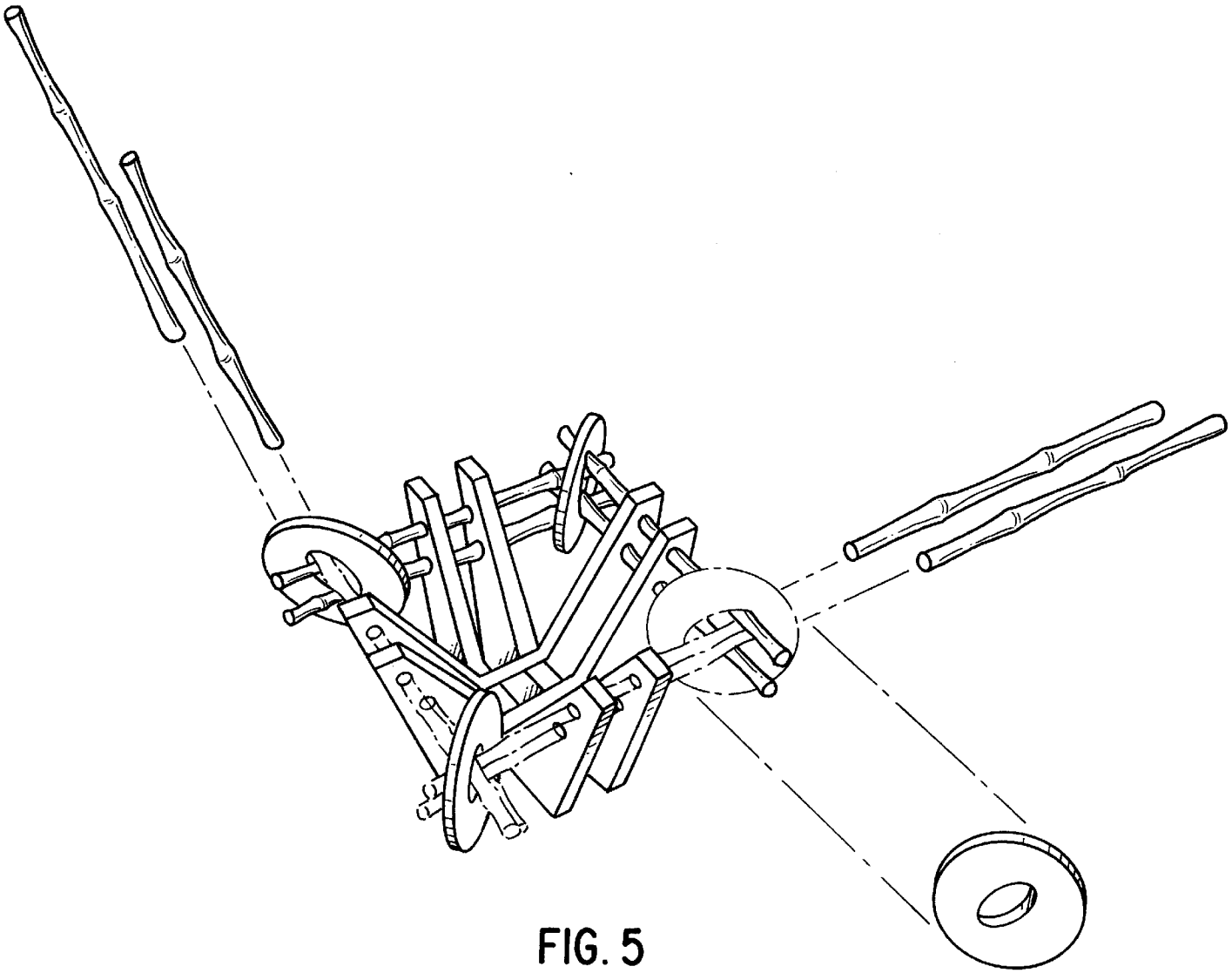

As shown in FIG. 3, once a suitable laminated beam element 12 is constructed, it is slotted, grooved or, notched, 20 to accommodate a mating beam. FIG. 3 shows the table of FIG. 1 having a plurality of tabulated apertures 22 sized appropriately to frictionally secure bars 16 shown in FIG. 1 to beam elements 12.

Figure 6:
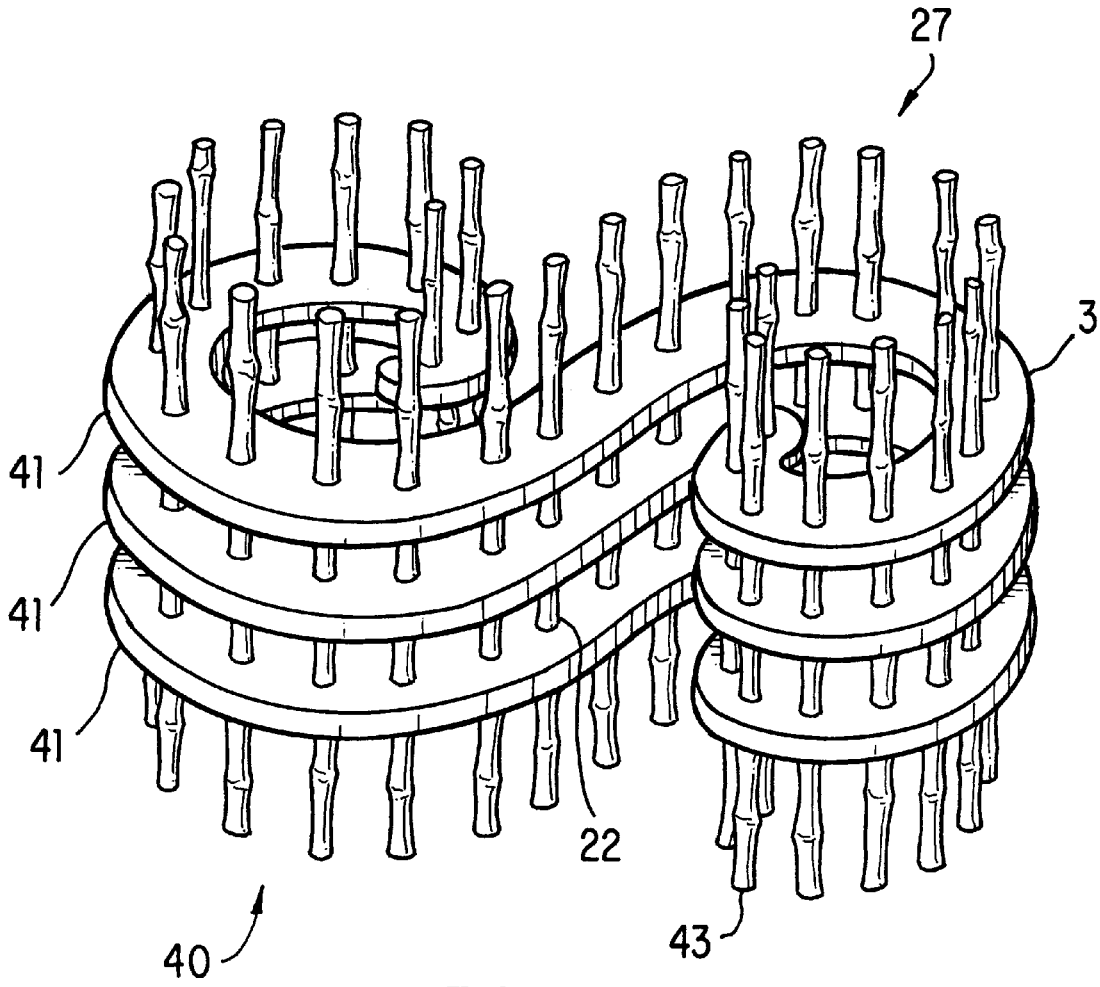
FIG. 6 is a perspective view of a second table manufactured using the method of the present invention.

One article of furniture constructed using the method of the present invention is an "S" shaped table sown as 40 in FIG. 6. The table 40 comprises 27 equal lengths of bamboo 43 each approximately 1 inch in diameter and 30 inches long. The lengths of bamboo 43 are arranged vertically and intersect three identical horizontal corrugated laminate components 41 which arc cut into stylized "S" shapes. The "S" shapes are 40 inches long, 20 inches wide and 1 inch thick. The corrugated components 41 each have 27 regularly spaced tabulated apertures 22 approximately 1 inch in maximum diameter cut through the flat face of the corrugated components 41. The tabulated apertures 22 allow for varying thickness of the bamboo to fit snugly in the aperture because of the softness of the corrugated material which will compress to accommodate the bamboo. The three horizontal laminated components 41 intersect the vertical bamboo lengths 43 at intervals of 15 inches, 20 inches and 25 inches in the height of this 30 inch high table. A glass or other heavy, flat table surface 48 is supported by the load bearing cut ends of the vertically arranged bamboo components 43. Alternatively, the same structure described above can be turned on its side so that the corrugated components are vertical and the bamboo is horizontal. In this position the vertical corrugated would be positioned further apart from each other so that a piece of glass or other heavy table top material can be rested upon the corrugated components' cut edges.

Figure 7:
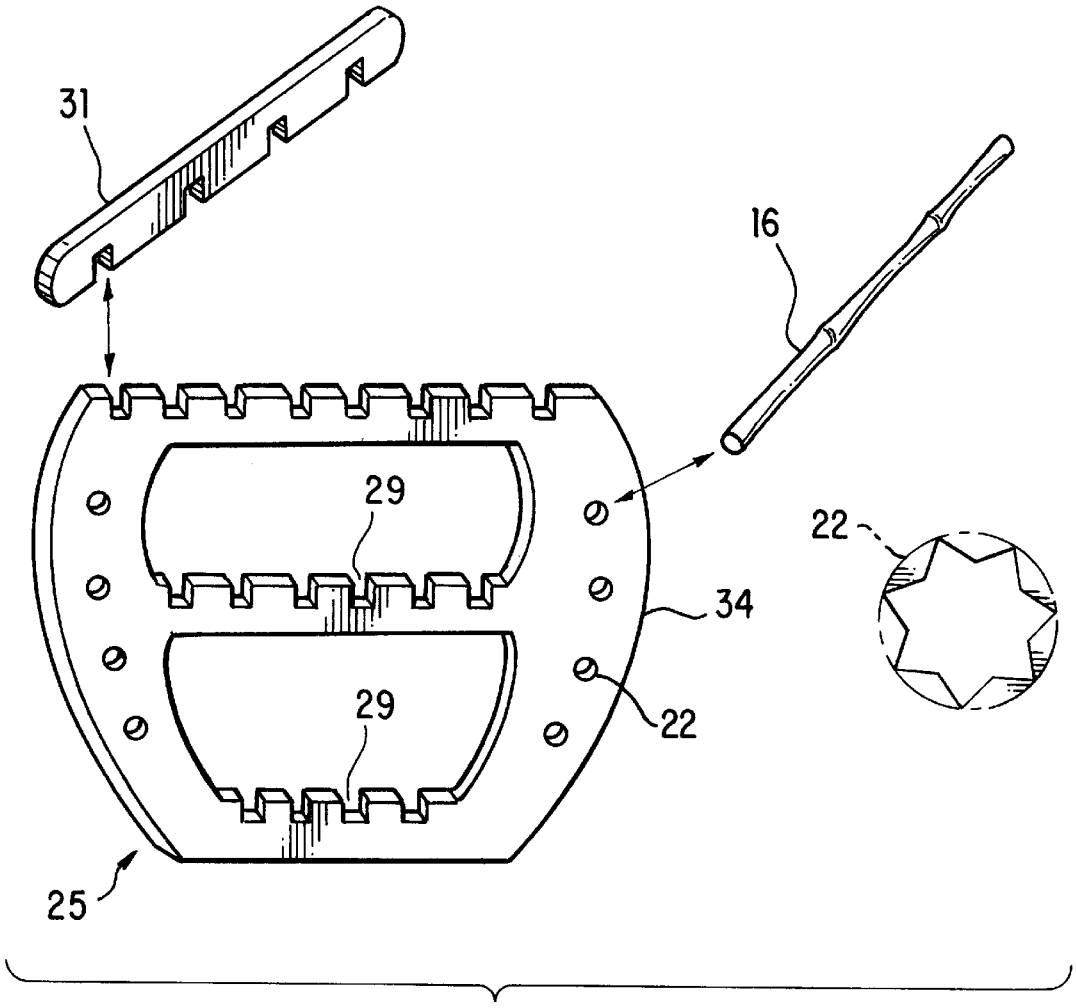
FIG. 7 is a partial view of a magazine rack manufactured using the method of the present invention.

Another embodiment constructed using the method of the present invention is a book and magazine rack partially shown as 25 in FIG. 7. The book & magazine table 25 is comprised of four identical vertical components of laminated corrugated sheets approximately 1 inch thick (only one shown as 34 in FIG. 7). These are intersected by eighteen horizontal laminated corrugated components (only one shown as 31 in FIG. 7) of similar thickness which form the table's top and two shelves underneath. The vertical components are approximately 40 inches tall by 30 inches wide and have cut-outs 29 that include openings for shelves as well as eight tabulated apertures 22 approximately 1 inch in diameter. There are uniformly spaced-apart tabulated apertures 22 along each side of the vertical components. Eight equal lengths of bamboo 16 approximately 2 inches longer than the maximum width of the assembled corrugated structure and approximately 1 inch in diameter are pushed through the tabulated apertures 22 horizontally to have a snug fit and overhang the outside vertical components by approximately 1 inch on either end. All corrugated components are notched to accept each other (horizontals into verticals) so that the table's top and shelf structures are flat and flush. The vertical components 34 are spaced approximately 12 inches apart to accommodate magazines of typical size which can be hung over the horizontal bamboo components. Horizontal corrugated components overhang the outside vertical components by 1 inch on either end, thus their total length is approximately 42 inches long including four 1 inch wide by 1 inch deep notches, spaced 12 inches apart from each other. These horizontal "slats" are 2 inches deep and as with the vertical components, the cut edges are the load bearing surface. The vertical components have similar sized notches to receive the slats and are cut-out so that the completed form has a top and shelf of 2 inch depth.

After reviewing this specification and attached drawings it will be obvious to one skilled in this field to understand that by using the method provided in the present invention one can construct an unlimited number of possible designs to form articles of furniture or other structures using a plurality of laminated beam elements, a plurality of connector elements combined with a plurality of lightweight bars.

Construction by this method eliminates the need for a continuous lamination of plies to form the ultimate structure as well as negating the need for folding plies to obtain strength or rigidity. The use of tabs, slots, and cut-outs on beam elements enable the creation of a rigid structure. An additional advantage offered by this method of construct is that the skeletal framework can be created in a number of different ways. Two such ways presently contemplated by the Inventor are to configure the contour of each respective beam element in a predetermined fashion dependent upon the location of the individual beam element. That is, the perimeter of the beam element is shaped so that the beam element corresponds with the desired contour of the entire structure at that location within the skeletal framework within which the beam element is placed. Another way is to create a finite number of beam element configurations and to incorporate a requisite number of individual configurations into an article. Both are preferred methods dependent upon the article sought to be manufactured. The former lending itself more readily to modem, curvilinear articles whereas the latter is more readily suitable to regular geometric structures. However, a combination of the two is also possible.

The inventor has contemplated two manners in which to make the laminated beam and connector elements. The first comprising laminating sheets of material together and cutting out individual beam elements and connector elements, the second cutting out individual plies of a desired shape and laminating each together to form the desired element. Either way is possible, however the Inventor would prefer the former due to the fact that a better glue bond would be formed and less shifting of plies would occur during the gluing process. This preferred method would also more easily accommodate tapered or beveled edges across the beam element or connector element should such an edge be desired.

The foregoing has described specific embodiments of the present invention. Additional variations will be apparent to those skilled in the art. For example, although the invention has been described in the context of a method of manufacturing furniture, it can also be used to make other types of load bearing, as well as non load bearing structures. Thus the invention is not limited to the specific details and illustrative examples shown and described in this specification, rather, it is the object of the appended claims to cover all such variations and modifications as come within the true spirit and scope of the invention.

What is claimed is:

1. A method of manufacturing furniture, comprising:

cutting two or more beam shaped plies from at least one sheet of at least one material, forming a plurality of beam elements by laminating two or more of said beam shaped plies, removing portions of said beam elements thereby forming slots, tabs, grooves, cut-outs, tabulated apertures, or tapered edges within said beam elements, cutting a plurality of bars of substantially equal thickness to have substantially equal lengths, combining a plurality of said beam elements by interconnecting at least one of said slots, tabs, grooves, cut-outs, tabulated apertures or tapered edges of one beam element with at least one of said slots, tabs, grooves, cut-outs, tabulated apertures or tapered edges in at least one other beam element, inserting a plurality of said bars into at least one of said slots, grooves, cut-outs or tabulated apertures in said beam elements, orienting at least a portion of said plurality of said beam elements or at least a portion of said plurality of bars to be in collinear alignment to a load acting upon said furniture, and orienting one or more of said beam elements in a configuration where edges of said beam elements are designed to come into contact with a load placed on said furniture.

2. The method according to claim 1 wherein said beam shaped plies are constructed of material selected from the group consisting of cardboard, wood, paper, paperboard, plastic or foam.

3. The method according to claim 1 wherein material of said bars is selected from the group consisting of bamboo, wood or plastic.

4. The method according to claim 1 wherein fiber cords are used for jointing the ends of said bars.

5. The method according to claim 1 further comprising of treating of said beam elements, said connector elements and said bars with a flame retardant.

6. The method according to claim 1 further comprising of treating of said beam elements, said connector elements and said bars with moisture repellant.

7. The method according to claim 1 further comprising of treating of said beam elements, said connector elements and said bars with polyurethane.

8. A method of manufacturing furniture, comprising:

cutting a plurality of beam shaped plies from at least one sheet of at least one material, forming a plurality of beam elements by laminating two or more of said beam shaped plies, removing portions of said beam elements thereby forming slots, tabs, grooves, cut-outs, tabulated apertures, or tapered edges within said beam elements, cutting a plurality of connector shaped plies from at least one sheet of at least one material, forming a plurality of connector elements by laminating at least one of said connector shaped plies, removing portions of said connector elements thereby forming slots, grooves, cut-outs or tabulated apertures within said connector elements, combining a plurality of said beam elements by interconnecting at least one of said slots, tabs, grooves, cut-outs, tabulated apertures or tapered edges of one beam element with at least one of said slots, tabs, grooves, cut-outs, tabulated apertures or tapered edges in at least one other beam element, cutting a plurality of bars of substantially equal thickness to have substantially equal lengths, inserting a plurality of said bars into at least one of said slots, grooves, cut-outs and tabulated apertures in said beam elements, jointing the ends of two or more of said bars together with said connector elements, and orienting one or more of said beam elements in a configuration where edges of said beam elements are designed to come into contact with a load placed on said furniture.

9. The method according to claim 8 wherein at least two of said bars have unequal lengths and thickness.

10. The method according to claim 8 further comprising enhanced laminating of said plies to enforce said beam elements to support a load of 1 kg or greater.

11. The method according to claim 10 wherein said beam shaped plies and said connector shaped plies are constructed of material selected from the group consisting of cardboard, wood, paper, paperboard, plastic or foam.

12. The method according to claim 8 further comprising selecting said bars of thickness sufficient to enable said bars to support a load of 1 kg or greater.

13. The method according to claim 12 wherein material of said bars is selected from the group consisting of bamboo, wood or plastic.

14. The method according to claim 8 wherein fiber cords are used for jointing the ends of said bars.

15. The method according to claim 8 further comprising of treating of said beam elements, said connector elements and said bars with a flame retardant.

16. The method according to claim 8 further comprising of treating of said beam elements, said connector elements and said bars with moisture repellant.

17. The method according to claim 8 further comprising of treating of said beam elements, said connector elements and said bars with polyurethane.

* * * * *